US005694378A

United States Patent [19]

Totsuka

[11] Patent Number: 5,694,378

[45] Date of Patent: Dec. 2, 1997

[54] TIME DISPLAY APPARATUS

[75] Inventor: Ryoichi Totsuka, Düsseldorf, Germany

[73] Assignee: Taiyo Musikinstrumente GmbH, Hilden, Germany

[21] Appl. No.: 529,496

[22] Filed: Sep. 18, 1995

[30] Foreign Application Priority Data

Sep. 22, 1994 [DE] Germany ..... 44 33 817.1

[51] Int. Cl.[6] ..... G04B 19/06

[52] U.S. Cl. ..... 368/223; 368/77; 368/233; 368/234

[58] Field of Search ..... 368/223, 233, 368/77, 234

[56] References Cited

U.S. PATENT DOCUMENTS

| | | | |
|---|---|---|---|
| 2,011,517 | 8/1935 | Geoffrion | 368/233 |
| 2,785,530 | 3/1957 | Mayer | 368/233 |

FOREIGN PATENT DOCUMENTS

| | | | |
|---|---|---|---|
| 6681569 A3 | 12/1988 | Switzerland | 368/77 |

*Primary Examiner*—Bernard Roskoski

*Attorney, Agent, or Firm*—Meltzer, Lippe, Goldstein et al.

[57] ABSTRACT

The invention relates to a time display apparatus consisting of at least two partly transparent discs (A, B, C) which are arranged concentrically and axially displaced with respect to one another, with each of the discs (A, B, C) being rotationally driven about the central axle with separately preselectable period duration and being provided with a visible marking for the display of hours, minutes and seconds, with one freely rotating disc (D, E) which carries a graphical representation being concentrically arranged axially adjacent to at least one of the rotationally driven discs (C). The invention is based on the object of displaying not only the time by means of the time display apparatus, but also of enabling special optical effects. This is achieved in such a way that the rotationally driven disc (C) is provided with a (first) entrainment means ($X_1$) on its side facing the freely rotatable disc, which means cooperates with a (first) actuating means ($X_2$) arranged on the side of the freely rotatable disc (D) facing the rotationally driven disc (C).

13 Claims, 2 Drawing Sheets

TIME DISPLAY APPARATUS

The invention relates to a time display apparatus consisting of at least two partly transparent discs (A, B, C) which are arranged concentrically and axially displaced with respect to one another, with each of the discs (A, B, C) being rotationally driven about the central axis with separately preselectable period duration and being provided with a visible marking for the display of hours, minutes and seconds, with one freely rotating disc (D, E) which carries a graphical representation being concentrically arranged axially adjacent to at least one of the rotationally driven discs (C).

A time display apparatus of this kind is known from DE-OS 39 40 254. It shows a time display apparatus which consists of transparent discs arranged parallel with respect to one another and axially behind one another for the display of hours, minutes and seconds, with the discs being held rotationally and being rotated by separate drives acting on the respective edge of the disc. Such a peripheral attack of the rotational drive requires a complex mechanism.

From DE-OS 25 48 559 a time display apparatus is known which is provided with transparent discs with index symbols which are driven by means of frictional wheels in front of or behind a transparent clockface. A further time display apparatus which is known from DE 24 11 799 C4 is provided with a window through which various areal zones provided with different colours can be recognized.

The invention is based on the object of providing a time display apparatus of the kind mentioned above in such a way that the diversity of the possibilities for display is increased in addition to pure display of time.

This object is achieved in accordance with the invention in that the rotationally driven disc is provided with a (first) entrainment means on its side facing the freely rotatable disc, which means cooperates with a (first) actuating means arranged on the side of the freely rotatable disc facing the rotationally driven disc.

The invention is characterized in that the freely rotatable disc is made to rotate by the influence of the entrainment means of the rotationally driven disc on the actuating means. This leads to a form-locked coupling of the discs during the partial sequence of movement of the rotationally driven disc. This is connected with a special optical and aesthetic effect, because the graphical representation on the freely rotatable disc is superimposed over the time markings on the rotationally driven discs. The rotary movement of the freely rotatable disc is dependent on the relative position of the time display apparatus with respect to the direction of gravity. When the disc axis shows in the direction of gravity, the freely rotatable disc is entrained by the entrainment means according to the rotational drive of the rotationally driven disc. If on the other hand the disc axis forms a specific angle with respect to the direction of gravity, the forced rotational movement of the freely rotatable disc depends on two components, i.e. the entrainment by the entrainment means and the effect of gravity. If, for example, the disc axis is located horizontally, the actuating means of the freely rotatable disc is at first in the lower position until it is grasped by the entrainment means during its rotary movement and is brought to the upper position. Thereafter the freely rotatable disc will rotate as a result of gravity alone after the actuating means and entrainment means are no longer in engagement. With the time display apparatus acting in such a way it is possible to achieve special optical effects in addition to the display of time, depending on the manner in which the graphical representation is moved on the freely rotatable disc.

The diversity of these effects is increased in such a way that a further freely rotatable disc bearing a further graphical representation is allocated to the one freely rotatable disc, with the one freely rotatable disc being provided on its side facing the other freely rotatable disc with a further entrainment means which cooperates with a further actuating means arranged on the side of the further freely rotatable disc facing the one freely rotatable disc.

A simple arrangement of the entrainment means and the actuating means provides that they are arranged as cylindrical elements whose longitudinal axes extend parallel to the central axle and that they each are provided with the same radial distance from the central axle.

When the entrainment means and actuating means are each arranged in the non-transparent zone of the discs, the optical impression which is caused by the graphical representations on the individual discs is not altered.

A preferred embodiment of the invention provides that discs mutually associated through entrainment means and actuating means are provided with partial, mutually associated representations and give the impression at the time of coupling that the two partial representations result in an associated moved image. If, for example, the one partial image is a ball and the other partial image is a bat for the ball then the impression arises at the time at which the entrainment means and the actuating means touch one another that the bat was hitting the ball.

If in accordance with a further preferred embodiment it is provided that at least one further rotationally driven disc is provided, them this will lead to a further increase in the diversity of possibilities for display. For example, this further rotationally driven disc may rotate several times faster than the period duration of a first rotationally driven disc.

If the drive of the driven disc occurs in a pulsed manner, e.g. via a stepper ratchet mechanism, then this will lead to the consequence that a short impulse is exerted on the freely rotatable disc, so that it will rotate about a certain angle before it stops as a result of the friction.

The apparatus as described above is preferably used both for wrist watches as well as grandfather clocks.

The invention is now explained in closer detail by reference to the enclosed drawing, wherein FIG. 1 shows an arrangement of several axially displaced discs for a time display apparatus;

Figure 1:
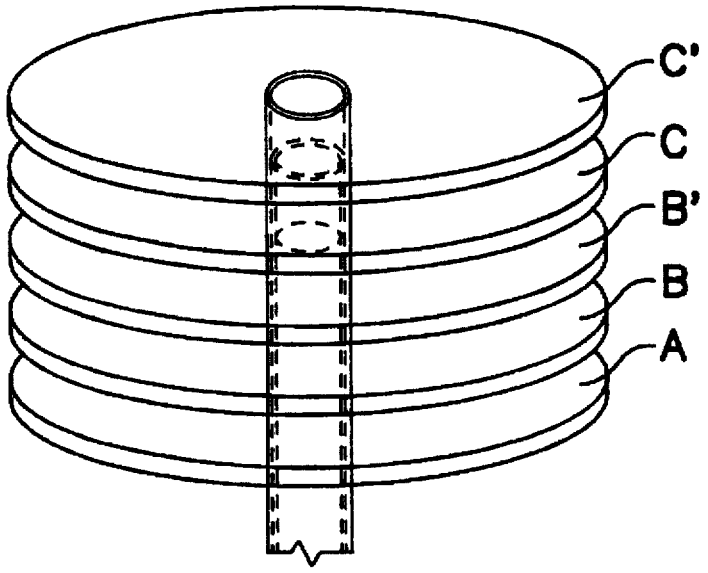
Figure 2:
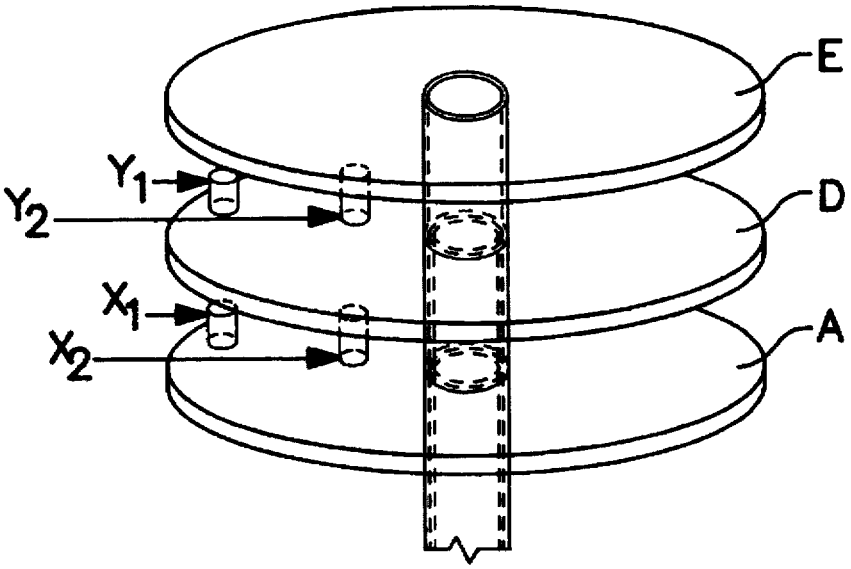
FIG. 2 shows a representation of an embodiment of the invention.
Figure 3:
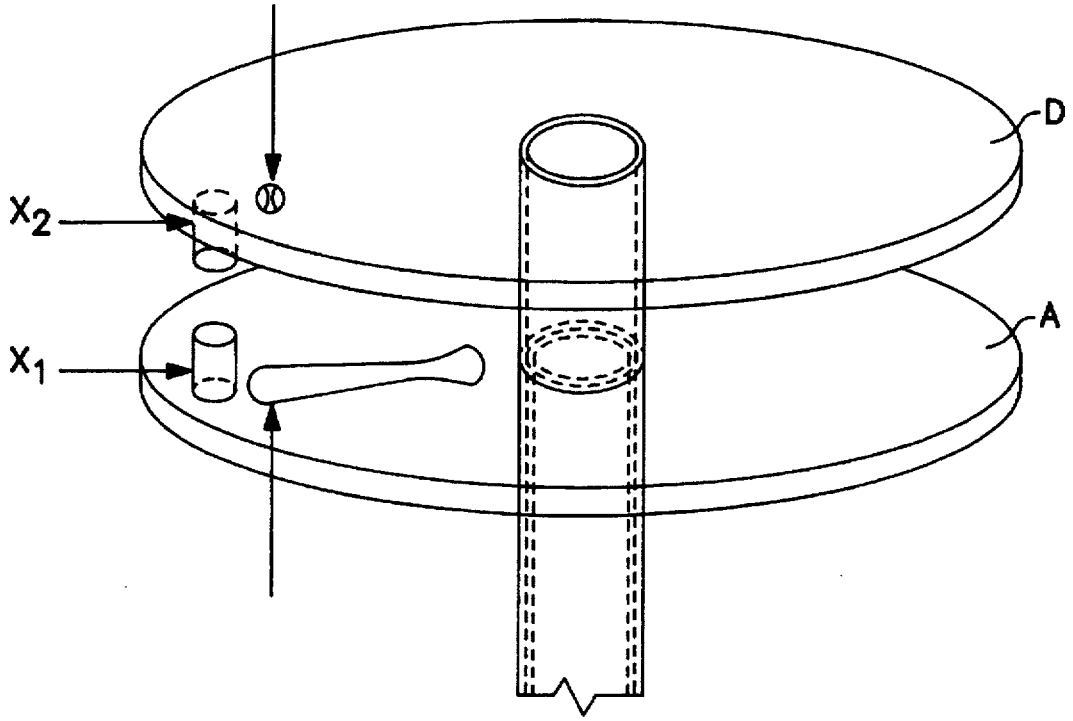
FIG. 3 shows a detailed representation of FIG. 2.

The embodiment shown in FIGS. 1 to 3 relates to a time display apparatus for a wrist watch.

In accordance with FIG. 1, the apparatus consists of five rotatable discs A, B, B', C, C' which are arranged concentrically with respect to one another. The discs A, B, C are each provided with markings and driven by a generally known rotary drive (not shown) in such a way that disc A enables the display of seconds, disc B the display of minutes and disc C the display of hours. The discs A, B, C are driven by rotary axles and hollow axles which are concentric with respect to the central axle. The desired durations of the periods of the rotary movement for the discs A, B, C are generated via a suitable mechanism, with a stepper ratchet mechanism preferably being provided for generating the rotary movement.

The discs B', C' which have been arranged in addition are each provided with one graphical representation which jointly or separately produces special optical effects during the rotary movement of the discs B', C'. The other discs A, B, C can also bear graphical representations. The representations may consist of figures or certain patterns or shadings of the discs. It must only be ensured that on viewing the discs the spectator must be able to recognize the position of the respective markings on discs A, B, C.

In the embodiment the discs B', C' are set to rotate two to three times faster than the discs B and C. It is also imaginable that one of the discs B', C' carries out a step-by-step angular movement, e.g. rotating every five seconds by 30°.

FIG. 2 shows in addition to FIG. 1 further discs D, E which cooperate with the disc A for the display of the seconds. The discs D, E are arranged concentrically to the central axle between discs A and B (FIG. 1). On the side of disc A facing disc D there is situated a (first) entrainment means $X_1$ at a predetermined radial distance from the central axle. On the side of disc D facing disc A there is situated a (first) actuating means $X_2$ at a predetermined radial distance from the central axle. If the (first) entrainment means $X_1$ and the (first) actuating means $X_2$ do not touch one another, disc D remains stationary because it is arranged freely rotationally on the central axle.

The disc E, which is arranged above, is also provided on its side facing the disc D with a further actuating means $Y_2$ which cooperates with a further entrainment means $Y_1$ provided on the side of disc D facing disc E. Disc E is also arranged freely rotationally on the central axle.

The function of the present invention is explained in closer detail below in connection with FIGS. 2 and 3. As the disc A corresponding to the display of seconds is rotationally controlled step-by-step about a specific predeterminable angle by means of a stepper ratchet mechanism, it meets the (first) actuating means $X_2$ of the momentarily stationary freely rotatable disc D with its (first) entrainment means $X_1$ during the rotation. When the (first) entrainment means $X_1$ comes into contact with the (first) actuating means $X_2$, an impulse is exerted on disc D, so that it rotates about an angle depending on the friction and thus comes out of contact with the (first) entrainment means $X_1$.

The rotation of the freely rotatable disc E is caused in a similar way by the rotation of disc D, this being in such a way that the further entrainment means $Y_1$ of the disc D pushes the disc E via the further actuating means $Y_2$.

This results in a successive movement of discs D, E caused by the stepwise movement of disc A, which produces an interesting optical effect in the event of respective graphical arrangement of the discs. The rotation of discs D, E follows the disc A approximately evenly only if discs A, D, E are in the horizontal position.

If the disc plane is tilted from the horizontal, a movement of discs D, E occurs which is caused by gravity, because they are provided with excessive weight on the respective side owing to the entrainment means $X_1$, $Y_1$ and actuating means $X_2$, $Y_2$. In this way the optical effect is overlapped by a component of coincidence.

FIG. 3 shows a special embodiment in the case that only one freely rotatable disc is associated with the driven disc A (display of seconds). The driven disc A carries a baseball bat as a symbol, whereas the freely rotatable disc D is provided with a baseball as a symbol. The association of the two partial images is chosen in such a way that in the event of spatial coincidence between the (first) entrainment means $X_1$ and (first) actuating means $X_2$ a contact between bat and ball is illustrated in particular. If the lower disc A moves towards the stationary disc D in such a way that the baseball bat moves towards the baseball, the impression is given at the time at which the (first) entrainment means $X_1$ "ticks on" the (first) actuating means $X_2$ as if the baseball bat were hitting the baseball because a respective rotary acceleration of the disc D occurs in the rotary direction of disc A.

I claim:

1. A time display apparatus, comprising:

(a) at least first and second partly transparent discs mounted on a central axle concentrically and axially displaced with respect to one another, and being rotationally driven at separately preselectable periods by said central axle, said rotationally driven discs having visible markings for the display of time thereon;

(b) at least a first freely rotatable disc arranged concentrically on said central axis axially adjacent to said first rotationally driven disc, said freely rotatable disc bearing a graphical representation thereon;

(c) said first rotationally driven disc having a first entrainment means located on a side thereof facing said freely rotatable disc; and (d) said freely rotatable disc having a first actuating means located on a side thereof facing said first rotationally driven disc;

(e) wherein said freely rotatable disc is caused to rotate when said first entrainment means comes into contact with said first actuating means.

2. The time display apparatus of claim 1, wherein said first actuating means and said first entrainment means comprise projecting pins having longitudinal axes that extend parallel to said central axle.

3. The time display apparatus of claim 1, further comprising:

(a) a second freely rotatable disc having a graphical representation thereon;

(b) a second actuating means located on a side of said first freely rotatable disc facing said second freely rotatable disc; and (c) a second entrainment means located on a side of said second freely rotatable disc facing said first freely rotatable disc;

(d) wherein said second freely rotatable disc is caused to rotate when said second entrainment means comes into contact with said second actuating means.

4. The time display apparatus of claim 3, wherein said first and second actuating means, and said first and second entrainment means, all comprise projecting pins having longitudinal axes that extend parallel to said central axle.

5. The time display apparatus of claim 1, wherein said first actuating means and said first entrainment means are each located at the same radial distance from said central axle.

6. The time display apparatus of claim 1, wherein said first actuating means and said first entrainment means are each located on non-transparent portions of their respective discs.

7. The time display apparatus of claim 1, wherein said rotationally driven discs bear graphical representations thereon.

8. The time display apparatus of claim 7, wherein the graphical representations on said first rotationally driven disc and on said freely rotatable disc cooperate with each other to form a unitary scene.

9. The time display apparatus of claim 1, further comprising, a third rotationally driven disc mounted on said central axle concentrically and axially displaced with respect to said first and second rotationally driven discs, said third rotationally driven disc being driven at a separately preselectable period.

10. The time display apparatus of claim 9 wherein said third rotationally driven disc bears a graphical representation thereon.

11. The time display apparatus of claim 1, wherein said central axle is driven by a stepper ratchet mechanism.

12. The time display apparatus of claim 1 comprising a wrist watch.

13. The time display apparatus of claim 1 comprising a grandfather clock.

* * * * *